US008800482B2

(12) United States Patent
Schwenke et al.

(10) Patent No.: US 8,800,482 B2
(45) **Date of Patent: *Aug. 12, 2014**

(54) APPARATUS AND METHOD OF DISPENSING CONDUCTIVE MATERIAL WITH ACTIVE Z-AXIS CONTROL

(75) Inventors: Robert Schwenke, Fowlerville, MI (US); Eric Van der Meulen, Wixom, MI (US); Billy Bui, Howell, MI (US); Keith Weiss, Fenton, MI (US)

(73) Assignee: Exatec LLC, Wixom, MI (US)

( * ) Notice: Subject to any disclaimer, the term of this patent is extended or adjusted under 35 U.S.C. 154(b) by 1377 days.

This patent is subject to a terminal disclaimer.

(21) Appl. No.: 11/321,567

(22) Filed: Dec. 29, 2005

(65) Prior Publication Data

US 2007/0175175 A1 Aug. 2, 2007

(51) Int. Cl.
*B05C 11/00* (2006.01)
*B05C 5/02* (2006.01)

(52) U.S. Cl.
CPC ..... *B05C 5/0225* (2013.01)
USPC ..... 118/669; 118/679; 118/683; 118/712

(58) Field of Classification Search
CPC ..... B05C 5/0225
USPC ..... 118/669, 679, 683, 684, 323, 712; 901/41–43; 347/6; 101/42
See application file for complete search history.

(56) References Cited

U.S. PATENT DOCUMENTS 3,744,032 A * 7/1973 Engelberger et al. ..... 700/159
3,811,483 A * 5/1974 Morrison ..... 141/1
4,291,642 A * 9/1981 Kolc ..... 118/415
4,420,812 A * 12/1983 Ito et al. ..... 700/252
4,463,359 A 7/1984 Ayata et al.
4,605,569 A * 8/1986 Shimada et al. ..... 427/256
4,692,351 A 9/1987 Maeda et al.
4,941,428 A * 7/1990 Engel ..... 118/680
4,983,875 A * 1/1991 Masaki et al. ..... 310/323.03
5,119,759 A * 6/1992 Hicks ..... 118/712

(Continued)

FOREIGN PATENT DOCUMENTS

EP 0023471 A1 2/2003
JP 10-211458 * 11/1998

(Continued)

OTHER PUBLICATIONS

English Machine Translation of JP10-211458 (undated).*

(Continued)

*Primary Examiner* — Laura Edwards
(74) *Attorney, Agent, or Firm* — Cantor Colburn LLP

(57) ABSTRACT

An apparatus for printing a conductive ink onto a plastic panel including an articulatable arm having an end that opposes a surface of the panel. A nozzle is mounted via a nozzle height actuator to the end of the arm, and the nozzle is coupled to a source of conductive ink. A flow regulator, coupled to the ink source, regulates the flow rate of ink out of the nozzle and is controlled by the controller. A height sensor is configured to output a height signal relative to the surface and the controller, which is coupled to the arm, the flow regulator, the nozzle height actuator and the sensor, is configured to control the arm, flow regulator, nozzle height actuator, and speed of nozzle movement such that a conductive trace of predetermined height and width is applied to the substrate.

20 Claims, 4 Drawing Sheets

(56) References Cited

U.S. PATENT DOCUMENTS

| | | | | |
|---|---|---|---|---|
| 5,339,103 | A * | 8/1994 | Schmidt et al. | 348/95 |
| 5,340,400 | A * | 8/1994 | Schmidt et al. | 118/313 |
| 5,558,716 | A * | 9/1996 | Mitani et al. | 118/674 |
| 5,618,347 | A * | 4/1997 | Clare et al. | 118/314 |
| 5,831,641 | A | 11/1998 | Carlson | |
| 6,008,473 | A | 12/1999 | Gillner et al. | |
| 6,360,656 | B2 | 3/2002 | Kubo et al. | |
| 6,689,219 | B2 * | 2/2004 | Birmingham | 118/669 |
| 7,858,899 | B2 | 12/2010 | Fujii et al. | |
| 2001/0003871 | A1 | 6/2001 | Patton et al. | |
| 2001/0019340 | A1 | 9/2001 | Kubo et al. | |
| 2002/0071772 | A1 * | 6/2002 | Isogai et al. | 417/292 |
| 2003/0029336 | A1 * | 2/2003 | Thompson et al. | 101/42 |
| 2003/0084845 | A1 * | 5/2003 | Prentice et al. | 118/679 |
| 2004/0033369 | A1 | 2/2004 | Fleming | |
| 2005/0056213 | A1 | 3/2005 | Iimori et al. | |
| 2007/0151996 | A1 | 7/2007 | Myoji | |
| 2009/0167817 | A1 | 7/2009 | Orr | |
| 2011/0262627 | A1 | 10/2011 | Schwenke et al. | |

FOREIGN PATENT DOCUMENTS

| | | | |
|---|---|---|---|
| JP | 11165406 | A | 6/1999 |
| JP | 2000006493 | A | 1/2000 |
| JP | 200238254 | A | 9/2000 |
| JP | 2001071285 | A | 3/2001 |
| JP | 2001328254 | A | 11/2001 |
| JP | 2002042585 | A | 2/2002 |
| WO | WO 03/011607 | | 2/2003 |
| WO | WO 2004/082934 | A1 | 9/2004 |

OTHER PUBLICATIONS

International Search Report—PCT/US2007/082528 (Jun. 6, 2008).

International Preliminary Report on Patentability; International Application No. PCT/US2006/045120; International Filing Date: Nov. 21, 2006; Date of Completion: Mar. 31, 2008; 10 Pages.

Japanese Patent No. 11165406 (A); Publication Date: Jun. 22, 1999; Abstract Only; 1 Page.

Japanese Patent No. 2000238254 (A); Publication No. 2000-09-05; Abstract Only; 1 Page.

Japanese Patent No. 2002042585 (A); Publication Date: Feb. 8, 2005; Machine Translation; 6 Pages.

International Search Report; International Application No. PCT/US2006/045120; International Filing Date: Nov. 21, 2006; Priority Date: Dec. 29, 2005; 2 Pages.

Written Opinion of the International Searching Authority; International Application No. PCT/US2006/045120; International Filing Date: Nov. 21, 2006; Priority Date: Dec. 29, 2005; 7 Pages.

International Search Report and Written Opinion of the International Searching Authority; International Application No. PCT/US2007/082528; International Filing Date: Oct. 25, 2007; Date of Mailing: Jun. 6, 2008; 15 Pages.

U.S. Appl. No. 13/355,684; "Apparatus and Method for Forming a Uniform Grid Line"; filed Jan. 23, 2012.

U.S. Appl. No. 13/400,825; "Application and Method for Printing Three Dimensional Articles"; filed Feb. 21, 2012.

Japanese Patent No. 2001071285 (A); Publication Date: Mar. 21, 2001; Abstract Only; 2 Pages.

Japanese Patent No. 2001328254 (A); Publication Date: Nov. 27, 2001; Abstract Only; 2 Pages.

JPH05253523; English Abstract; Date of Publication: Oct. 5, 1993; 10 pages.

JPH06196743 English Abstract; Date of Publication: Jul. 15, 1994; 27 pages.

JPH0742163U English Abstract; Date of Publication: Jul. 21, 1995; 1 page.

JPS62241782 English Abstract; Date of Publication Oct. 22, 1987; 1 page.

* cited by examiner

APPARATUS AND METHOD OF DISPENSING CONDUCTIVE MATERIAL WITH ACTIVE Z-AXIS CONTROL

BACKGROUND

1. Field of the Invention

This invention relates to an apparatus and method of printing a conductive heater grid design on plastic or glass glazing panels, such as those used as backlights in vehicles.

2. Related Technology

Plastic materials, such as polycarbonate (PC) and polymethylmethyacrylate (PMMA), are currently being used in the manufacturing of numerous automotive parts and components, such as B-pillars, headlamps, and sunroofs. Automotive rear window (backlight) systems represent an application for these plastic materials due to their many identified advantages, particularly in the areas of styling/design, weight savings, and safety/security. More specifically, plastic materials offer the automotive manufacturer the ability to reduce the complexity of the rear window assembly through the integration of functional components into the molded plastic system, as well as the ability to distinguish their vehicles by increasing overall design and shape complexity. Being lighter in weight than conventional glass backlight systems, their incorporation into the vehicle may facilitate both a lower center of gravity for the vehicle (and therefore better vehicle handling & safety) and improved fuel economy. Further, enhanced safety is realized, particularly in a roll-over accident because of a greater probability of the occupant or passenger being retained in a vehicle.

Although there are many advantages associated with implementing plastic windows, these windows are not without limitations that represent technical hurdles that must be addressed prior to wide-scale commercial utilization. Limitations relating to material properties include the stability of plastics during prolonged exposure to elevated temperatures and the limited ability of plastics to conduct heat. Regarding the latter, in order to be used as a backlight in a vehicle, the plastic material must be compatible with the use of a defroster or defogging system (hereafter just referred to as a "defroster"). For commercial acceptance, a plastic backlight must meet the performance criteria established for the defrosting or defogging of glass backlights.

The difference in material properties between glass and plastics becomes quite apparent when considering heat conduction. The thermal conductivity of glass ($T_c$=22.39×$10^{-4}$ cal/cm-sec-° C.) is approximately 4-5 times greater than that exhibited by a typical plastic (e.g., $T_c$ for polycarbonate=4.78×$10^{-4}$ cal/cm-sec-° C.). Thus, a defroster designed to work effectively on a glass window may not necessarily be efficient at defrosting or defogging (hereafter just "defrosting" or "defrost") a plastic window. The lower thermal conductivity of the plastic may limit the dissipation of heat from the heater grid lines across the surface of the plastic window. Thus, at a similar power output, a heater grid on a glass window may defrost the entire viewing area, while the same heater grid on a plastic window may only defrost those portions of the viewing area that are close to the grid lines.

A second difference between glass and plastics that must be overcome is related to the electrical conductivity exhibited by a printed heater grid. The thermal stability of glass, as demonstrated by a relatively high softening temperature (e.g., $T_{soften}$>>1000° C.), allows for the sintering of a metallic paste on the surface of the glass window to yield a substantially inorganic frit or metallic wire. Since the softening temperature of glass is significantly greater than the glass transition temperature of a typical plastic resin (e.g., polycarbonate $T_g$=145° C.), a metallic paste cannot be sintered onto a plastic panel. Rather, it must be cured on the panel at a temperature lower than the $T_g$ of the plastic resin.

A metallic paste typically consists of metallic particles dispersed in a polymeric resin that will bond to the surface of the plastic to which it is applied. The curing of the metallic paste provides a conductive polymer matrix having closely spaced metallic particles dispersed throughout a dielectric layer. The presence of the dielectric layer (e.g., polymer) between dispersed conductive particles leads to a reduction in the conductivity, or an increase in resistance, of the cured heater grid lines, as compared to dimensionally similar heater grid lines sintered onto a glass substrate. This difference in conductivity manifests itself in poor defrosting characteristics exhibited by the plastic window, as compared to the glass window.

With the above in mind, it is clear that controlling the quality of the heater grid printed onto the panel is important to maximizing the efficiency and effectiveness of any defroster used with that panel. Various parameters affect the quality of the printed heater grid and these parameters include any variances in the width, height and straightness of the grid lines. The more variances that exist in width and height, the greater the negative impact on the effectiveness of the defroster. This is a result of unequal resistances in various sections of the grid line and busbars resulting in unequal resistive heating in various sections of the defroster. With regard to straightness, this is mainly an aesthetic concern that becomes more of an issue because of the ability of plastic window assemblies to have greater design flexibility and curvature.

A defroster may be printed directly onto the surface inner or outer of a panel, or on the surface of a protective layer, using a conductive ink or paste and various methods known to those skilled in the art. Such methods include, but not limited to, screen-printing, ink jet printing and automatic dispensing. Automatic dispensing includes techniques known to those skilled in the art of adhesive application, such as drip & drag, streaming, and simple flow dispensing. In each of the above instances, the shape of the panel impacts the quality of the printed lines, i.e. screen printing becomes very difficult on non-planer panels, and the speed at which printing is done both the width and height of the grid lines. Slower speeds and higher flow for the ink or paste rates can result in wider and higher grid lines. Conversely, higher speeds and slower flow rates can result in slimmer and lower grid lines. With screen printing in particular, the height of the grid line is not readily variable.

From the above, it is seen that there is a need in the industry for an apparatus and method that can effectively control the quality and consistency with which grid lines are printed onto a panel.

SUMMARY OF THE INVENTION

In satisfying the above need, as well as overcoming the enumerated drawbacks and other limitations of the related art, the present invention provides an apparatus for printing grid lines formed from a conductive ink onto a plastic substrate or panel. The apparatus includes a support bed adapted to support the panel and an articulatable arm positioned relative the support bed such that an end of the arm opposes a surface of the panel to be printed. A dispensing nozzle is carried by the arm and mounted thereto at the end of the arm; the nozzle being coupled to a source of conductive ink and to a nozzle height actuator that mounts the nozzle to the arm. Finally, a flow regulator is coupled to the ink source and the nozzle whereby the flow rate of conductive ink out of the nozzle is regulated. The apparatus also includes a height sensor that is configured to output a height signal relative to the surface of the panel. A controller, coupled to the arm, the flow regulator, the nozzle height actuator and the height sensor, is configured to articulate the arm so as to move the nozzle in a predetermined pattern about the surface of the panel. In addition, the controller is configured to control at least one of the flow regulator and the nozzle height actuator as a function of the speed at which the nozzle is moved, the height signal from the height sensor and/or the flow rate of conductive ink out of the nozzle, such that a conductive trace of predetermined height and width is applied to the panel.

Further objects, features and advantages of this invention will become readily apparent to persons skilled in the art after a review of the following description, with reference to the drawings and claims that are appended to and form a part of this specification.

DETAILED DESCRIPTION

Figure 1:
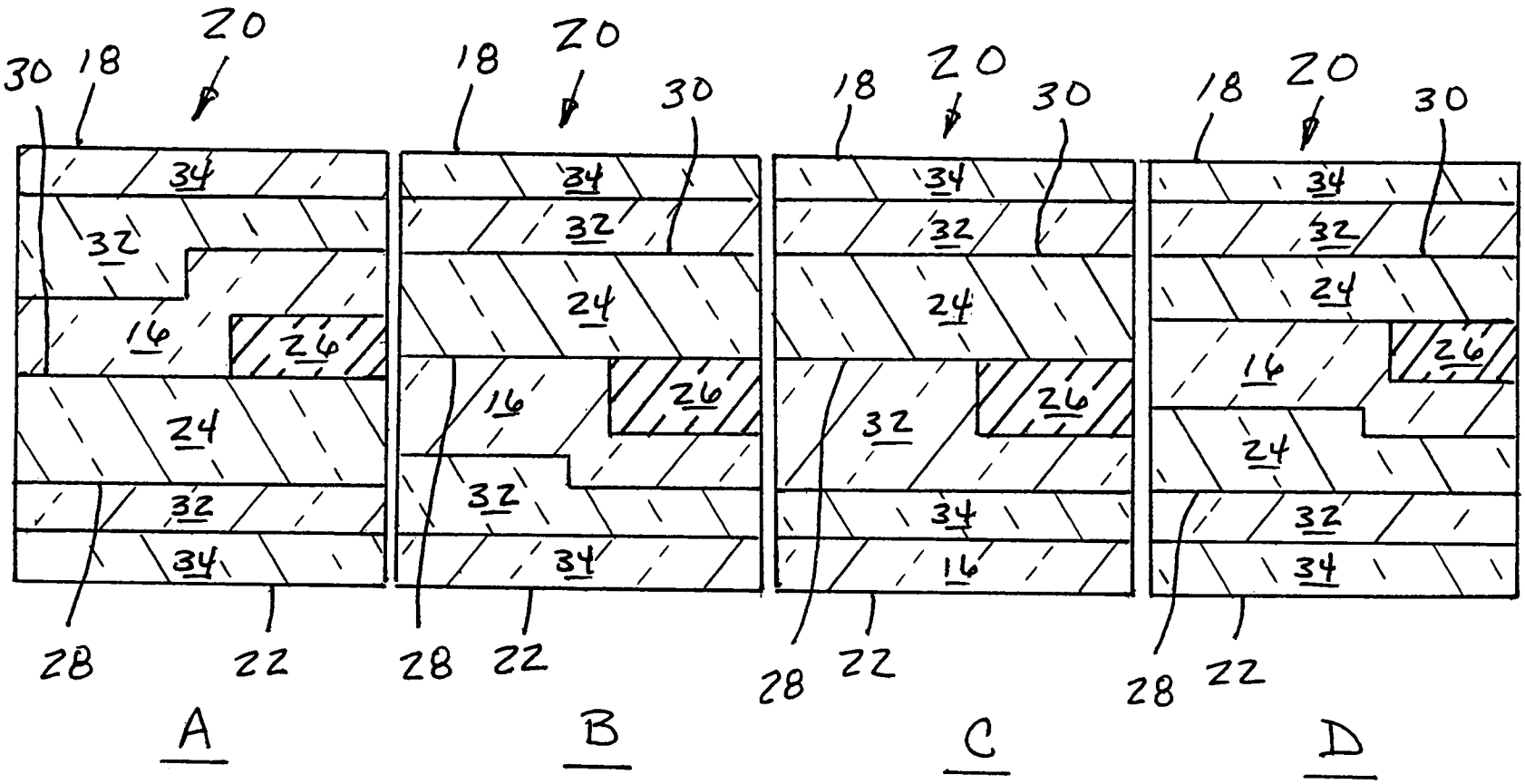
FIG. 1 is a schematic sectional view of four alternative embodiments of a window assembly according to the present invention.

Referring now to the drawings and as seen in FIG. 1, a defroster or heater grid 16 may be positioned near the external surface 18 of a plastic window assembly 20 (schematic A), on an internal surface 22 of the plastic window assembly 20 (schematic B and C), or encapsulated within the plastic panel (Schematic D) itself. Each of the possible positions for the heater grid 16 offers different benefits in relation to overall performance and cost. Positioning the heater grid 16 near the external surface 18 (schematic A) of the window assembly 20 is preferred so as to minimize the time necessary to defrost the window assembly 20. Positioning the heater grid 16 on the internal surface 22 (Schematic B and C) of a plastic panel 24 of the window assembly 20 offers benefits in terms of ease of application and lower manufacturing costs.

The transparent plastic panel 24 itself may be constructed of any thermoplastic polymeric resin or a mixture or combination thereof. Appropriate thermoplastic resins include, but are not limited to, polycarbonate resins, acrylic resins, polyarylate resins, polyester resins, and polysulfone resins, as well as copolymers and mixtures thereof. The panels 24 may be formed into a window through the use of any of the various known techniques, such as molding, thermoforming, or extrusion. The panels 24 may further include areas of opacity applied by printing an opaque ink on the panel 24 in the form of a black-out border 26 or molding a border using an opaque resin.

The heater grid 16 may be printed directly onto the inner surface 28 or outer surface 30 of the plastic panel 24. Alternatively, it may be printed on the surface of one or more protective layers 32, 34. In either construction, printing is affected using a conductive ink.

In its final construction, the plastic panel 24 may be protected from such natural occurrences as exposure to ultraviolet radiation, oxidation, and abrasion through the use of a single protective layer 32 or additional, optional protective layers 34, both on the exterior side and/or interior side of the panel 24. As the term is used herein, a transparent plastic panel 24 with at least one protective layer 32 is defined as a transparent plastic glazing panel.

The protective layers 32, 34 may be a plastic film, an organic coating, an inorganic coating, or a mixture thereof. The plastic film may be of the same or different composition as the transparent panel. The film and coatings may comprise ultraviolet absorber (UVA) molecules, rheology control additives, such as dispersants, surfactants, and transparent fillers (e.g., silica, aluminum oxide, etc.) to enhance abrasion resistance, as well as other additives to modify optical, chemical, or physical properties. Examples of organic coatings include, but are not limited to, urethanes, epoxides, and acrylates and mixtures or blends thereof. Some examples of inorganic coatings include silicones, aluminum oxide, barium fluoride, boron nitride, hafnium oxide, lanthanum fluoride, magnesium fluoride, magnesium oxide, scandium oxide, silicon monoxide, silicon dioxide, silicon nitride, silicon oxy-nitride, silicon oxy-carbide, silicon carbide, tantalum oxide, titanium oxide, tin oxide, indium tin oxide, yttrium oxide, zinc oxide, zinc selenide, zinc sulfide, zirconium oxide, zirconium titanate, or glass, and mixtures or blends thereof.

The protective coatings applied as protective layers 32, 34 may be applied by any suitable technique known to those skilled in the art. These techniques include deposition from reactive species, such as those employed in vacuum-assisted deposition processes, and atmospheric coating processes, such as those used to apply sol-gel coatings to substrates. Examples of vacuum-assisted deposition processes include but are not limited to plasma enhanced chemical vapor deposition, ion assisted plasma deposition, magnetron sputtering, electron beam evaporation, and ion beam sputtering. Examples of atmospheric coating processes include but are not limited to curtain coating, spray coating, spin coating, dip coating, and flow coating.

As an illustrative example, a polycarbonate panel 24 comprising the Exatec® 900 automotive window glazing system with a printed defroster 16 generally corresponds to the embodiment of schematic C of FIG. 1. In this particular case, the transparent polycarbonate panel 24 is protected with a multilayer coating system (Exatec® SHP-9X, Exatec® SHX, and a deposited layer of a "glass-like" coating ($SiO_xC_yH_z$) that is then printed with a heater grid 16 on the exposed surface of the protective layer 34 facing the interior of the vehicle. As a further alternative construction, a heater grid 16 may be placed on top of a layer or layers of a protective coating or coatings 32, 34, and then over-coated with an additional layer or layers of a protective coating or coatings. For instance, a heater grid 16 may be placed on top of a silicone protective coating (e.g., AS4000, GE Silicones) and subsequently over-coated with a "glass-like" film.

Figure 2:
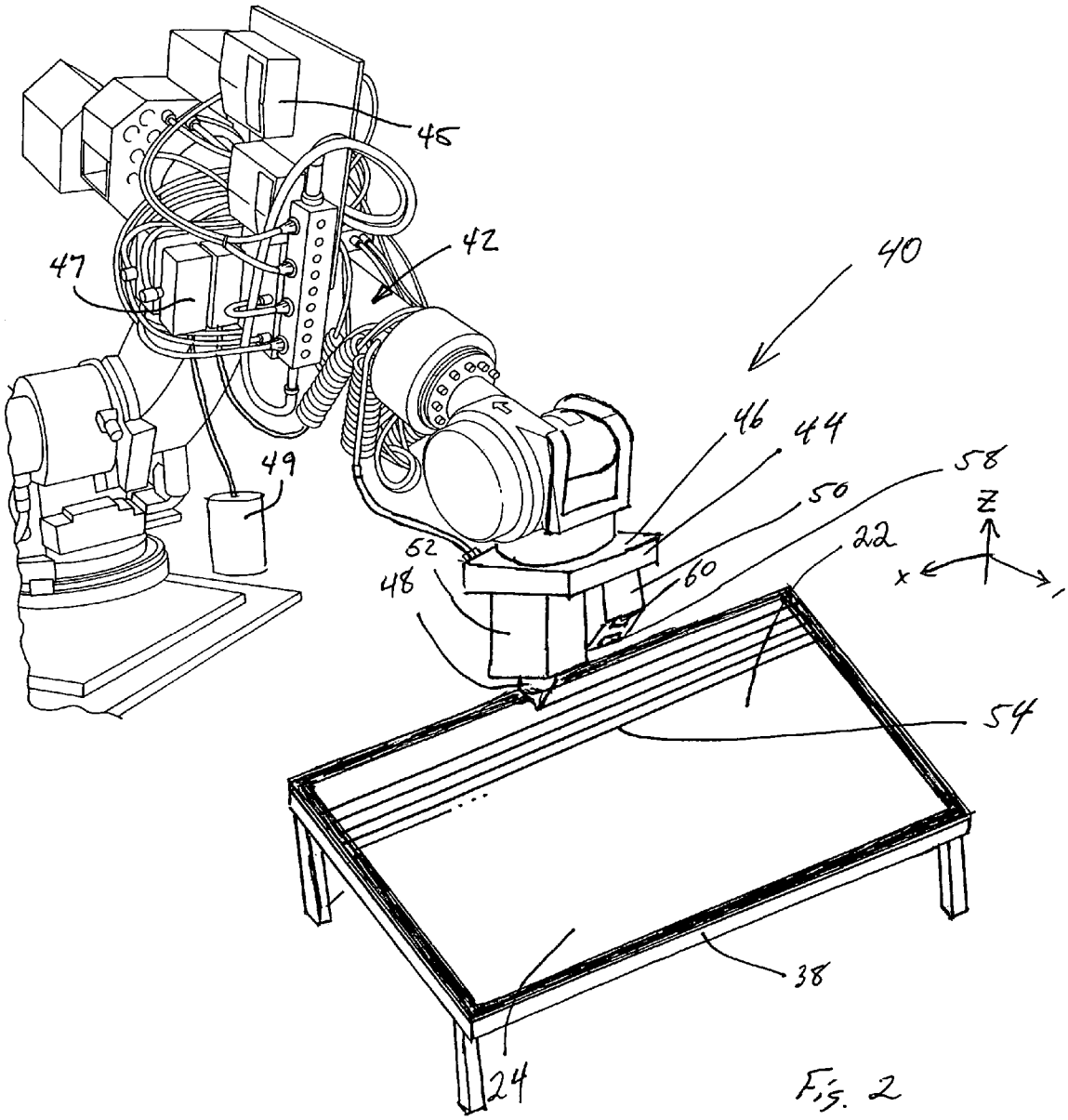
FIG. 2 is a perspective view of a robot arm traversing a dispensing head over a panel of a window assembly.
Figure 3:
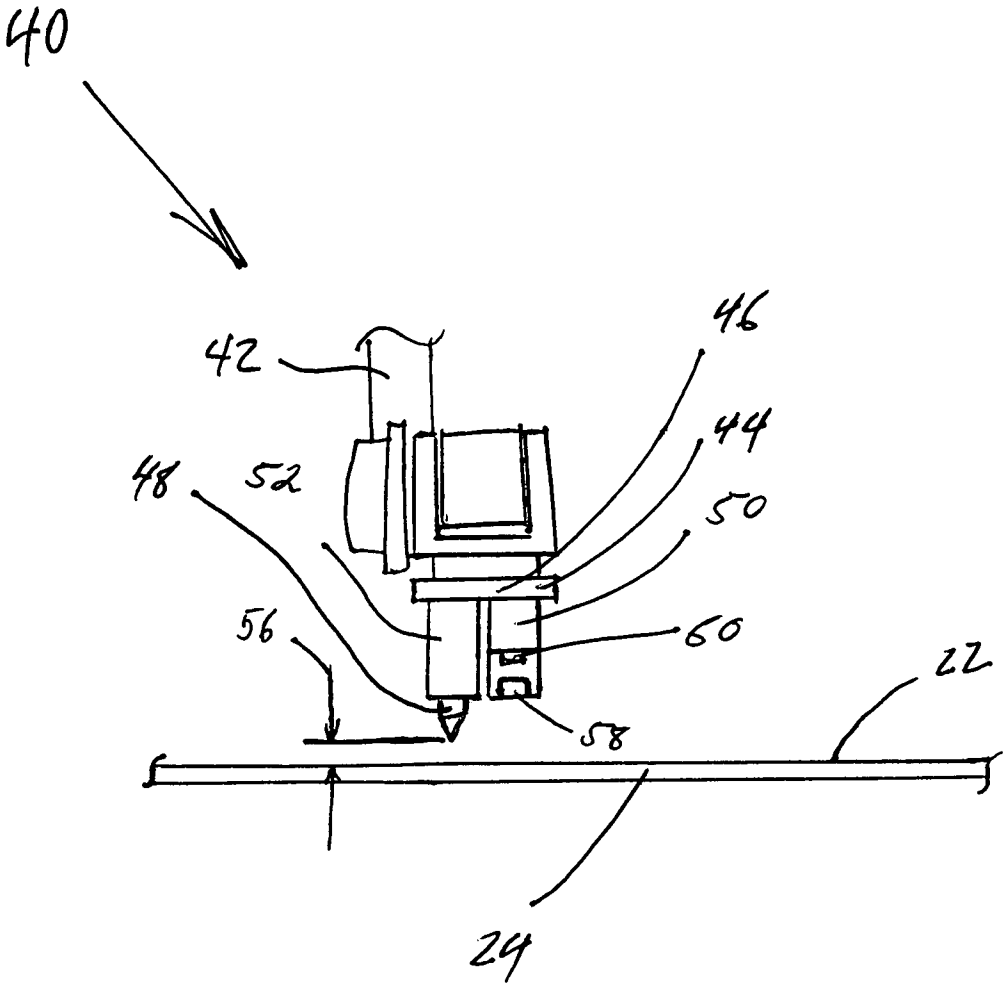
FIG. 3 is a partial front view of the robot arm and dispensing head over the panel.

Turning now to the present invention, FIG. 2 illustrates a machine 40, which may be a robotic arm or other device, having active z-axis control for dispensing conductive ink upon the panel 24, resting on a support 38, to form a series of heater grid lines 54. The machine 40 illustrated in the figure is comprised of a robot arm 42, mounted in a stationary manner to a support surface, and a dispensing head 44 attached to the end of the robot arm 42. A controller 45 is electrically coupled to the robot arm 42, the dispensing head 44 and a flow regulator 47 fluidly coupled to a conductive ink source 49. The robot arm 42 is articulatable and capable of moving the dispensing head 44 to any point on the surface 22 of the panel 24. In a preferred operation, the robot arm 42 moves the dispensing head 44 in a linear direction across the panel 25 and the dispensing head dispenses the conductive ink from the source 49 onto the panel 25 in lines, forming the heater grid lines 54, only some of which are shown in FIG. 2 for clarity. While this is an exemplary embodiment, other examples may dispense the heater grid lines 54 in any other pattern, such as curves.

Looking more closely at the dispensing head 44, it is primarily composed of a base 46 supported by the robot arm 42. Coupled to the base 46 is a sensor 50 and an actuator 52, to which a nozzle 48 is mounted and further coupled to the conductive ink source 49 and flow regulator 47. The flow regulator 47 may be any device capable of controlling the flow rate of ink from the ink source 49 to the nozzle 48. During operation, by means of the flow regulator, the conductive ink is dispensed through the nozzle 48, onto the internal surface 22 of the panel 24. The flow regulator 47 may include but not be limited to a means of positively displacing the fluid, such as that known to occur via an auger, a piston, or a gear mechanism.

To ensure the ink is dispensed in a manner to form a grid line 54 of the desired predetermined width and height, the sensor 50, directly or indirectly, measures the distance of the dispensing head 48 from the surface 22 of the panel 24. As a result, the controller 45, while controlling the robot arm 42 to move the dispensing head 44 to a desired position over the surface 22, actively controls a z-axis position of the nozzle 48 using the actuator 52 based on input from the sensor 50. The actuator 52 translates the position of the nozzle 48 to within a precise height 56 along the z-axis, (see FIG. 2), that lies preferably within 0-3 mm, but more typically between 0.5-1 mm, from the surface 22, depending on the desired characteristics of the grid lines 54. While the actuator 52 is a linear motor, alternative embodiments may use any electric, hydraulic, pneumatic, piezoelectric, electromagnetic, or other actuator 52 capable of similar precision and response time.

The sensor 50 is any sensor capable of measuring a height 56 from the surface 22 of the panel and must be capable of measuring relative to a semi-reflective and/or transparent surface. In the example shown, the sensor 50 comprises a triangulation laser arrangement made up of an emitter 58 and a receiver 60. To measure the distance of the nozzle 48 from the internal surface 22, laser light is projected from the emitter 58 and either directed or reflected onto the surface 22. The light is then reflected back to the receiver 60 and, based on the relative positions of the emitter 58 to the receiver 60, the sensor 50 calculates, by triangulation, the distance of the surface 22 from a reference point of the sensor 50. The height 56 is then calculated by the controller 45 based on the signal from the sensor 50 and a known position of the actuator 52 and the nozzle 48. As a result, the controller 45 may command the actuator 52 to raise or lower the nozzle 48 along the z-axis to compensate for variations in the surface of the panel 24 and maintain a predetermined height 56 above the surface 22.

While the exemplary sensor 50 is a laser triangulation sensor, any other non-contact sensor 50 could also be used, for example, a photonic sensor (i.e. measures the intensity of the reflected light), an air pressure sensor, an ultrasonic sensor, a magnetic sensor, or any other sensor. Additionally, contact sensors with appropriate means contacting the surface 22 in an appropriate manner (i.e. rolling contacts, sliding contacts, etc.) are also anticipated as being applicable with the present invention.

Figure 4:
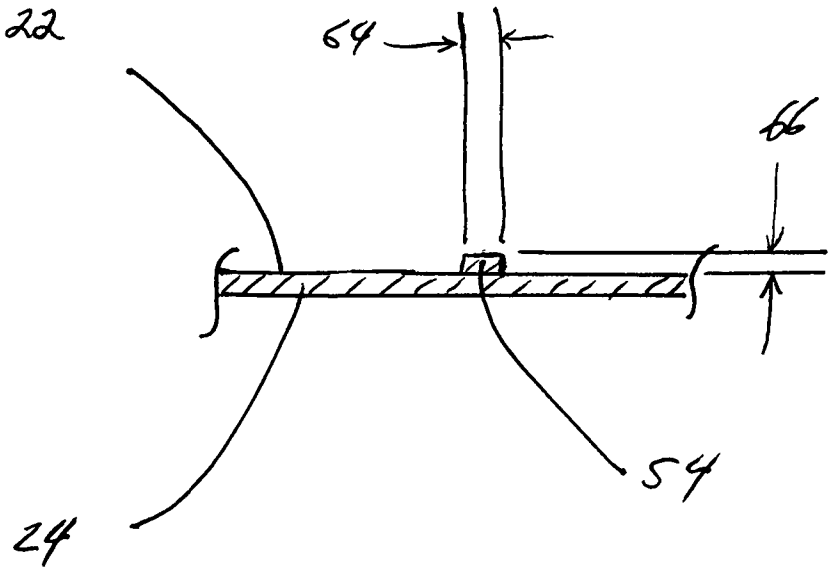
FIG. 4 is a close up, cross sectional view of a heater grid line disposed on the panel.

As a result, this arrangement allows for the precise control of the characteristics of the heater grid lines 54 by varying (increasing or decreasing) the height 56 (h) of the dispensing head 44 relative to the panel 24 and the flow rate (r) at which the ink is dispensed, based on the speed at which the dispensing head is being moved across the panel. Therefore, by precisely adjusting the height of the nozzle 48 relative to the contour of the panel 24, and/or adjusting the flow rate of conductive ink from the nozzle 48, the apparatus 40 is able to dispense the ink in extremely straight lines of consistent width 64 and height 66 (see FIG. 4). Furthermore, by varying one or more of the height 56 (h), the speed (s) and flow rate (r) of ink, the width 64 and height 66 of the heater grid lines may be varied depending on the technical and aesthetic requirements of a particular application. By varying the height of the gridlines 54, and therefore the cross sectional area of grid lines 54, the resistivity in that section of the grid line can be varied without altering the visible aesthetics of the line (e.g. the line shows a constant width). Thus one benefit of the present invention is that the time consuming scanning and mapping of the entire surface contour of the panel prior to initiating the printing of the grid lines 54 is avoided.

While the present embodiment compensates for variations in the z-axis, alternate embodiments may also compensate for variations in the x and y axes in order to keep the nozzle 48 normal to the surface 22 at all times as it traverses the panel 24. This configuration (not shown) may be achieved using a plurality of sensor's 50 and actuator's 52 to manipulate the nozzle accordingly. In one embodiment, at least two additional sensor's 50 would measure the positions (x & y axes) of the surface 22 to determine curvature in the panel. Based on inputs from these sensors, the controller 45 would command the robot arm 42 and/or additional actuator's to precisely rotate the nozzle 48 about the x-axis and y-axis, in addition to translating along the z axis. As a result, the controller 45 may keep the nozzle 48 normal to the surface 22 at all times as it translates across the panel 24.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

We claim:

1. An apparatus for printing a conductive ink onto a plastic panel, the apparatus comprising:

a support adapted to support the panel;

an articulatable member positioned relative to the support such that an end of the member opposes a surface of the panel to be printed;

a nozzle carried by the member and mounted thereto at the end, the nozzle being coupled to a source of the conductive ink;

a nozzle height actuator mounting the nozzle to the member;

a flow regulator coupled to the ink source and the nozzle, the flow rate of conductive ink out of the nozzle being regulated by the flow regulator;

a height sensor configured to measure a distance of the nozzle from the surface of the panel and output a height signal relative to the surface of the panel; and a controller coupled to the member, the flow regulator, the nozzle height actuator and the height sensor, the controller being configured to cause articulation of the member so as to move the nozzle in a predetermined pattern about the surface of the panel, whereby the controller is configured to control at least one of the flow regulator and the nozzle height actuator as a function of at least one of the speed at which the nozzle is moved, the height signal from the height sensor and the flow rate of conductive ink out of the nozzle, such that a conductive trace of predetermined height and width is applied to the panel.

2. The apparatus for printing a conductive ink according to claim 1 wherein the controller is configured to cause articulation of the nozzle to maintain the nozzle at an orientation normal to the surface of the panel.

3. The apparatus for printing a conductive ink according to claim 2 wherein the nozzle is mounted to the member via a plurality of actuators, the plurality of actuators includes an x-axis rotation actuator and a y-axis rotation actuator respectively configured to cause rotation of the nozzle about x and y axes.

4. The apparatus for printing a conductive ink according to claim 2 wherein member includes a plurality of sensors, the sensors including an x-axis sensor and a y-axis sensor.

5. The apparatus for printing a conductive ink according to claim 1 wherein the member is a robot.

6. The apparatus for printing a conductive ink according to claim 1 wherein the member is a robot arm.

7. The apparatus for printing a conductive ink according to claim 1 wherein the sensor is a laser sensor.

8. The apparatus for printing a conductive ink according to claim 1 wherein the sensor is a photonic sensor.

9. The apparatus for printing a conductive ink according to claim 1 wherein the sensor is an air sensor.

10. The apparatus for printing a conductive ink according to claim 1 wherein the sensor is a magnetic sensor.

11. The apparatus for printing a conductive ink according to claim 1 wherein the sensor is a non-contact sensor.

12. The apparatus for printing a conductive ink according to claim 1 wherein the sensor is a contact sensor.

13. The apparatus for printing a conductive ink according to claim 1 wherein the flow regulator includes an auger mechanism.

14. The apparatus for printing a conductive ink according to claim 1 wherein the flow regulator includes a piston mechanism.

15. The apparatus for printing a conductive ink according to claim 1 wherein the flow regulator includes a gear mechanism.

16. The apparatus for printing a conductive ink according to claim 1 wherein the nozzle height actuator is a linear motor.

17. The apparatus for printing a conductive ink according to claim 1 wherein the nozzle height actuator is a hydraulic actuator.

18. The apparatus for printing a conductive ink according to claim 1 wherein the nozzle height actuator is a pneumatic actuator.

19. The apparatus for printing a conductive ink according to claim 1 wherein the nozzle height actuator is a piezoelectric actuator.

20. The apparatus for printing a conductive ink according to claim 1 wherein the nozzle height actuator is an electromagnetic actuator.

* * * * *